US006290867B1

(12) United States Patent
Kielbania, Jr. et al.

(10) Patent No.: US 6,290,867 B1
(45) Date of Patent: Sep. 18, 2001

(54) TREATMENT COMPOSITION WHICH PROVIDES ANTI-WRINKLING PROPERTIES TO TEXTILES

(75) Inventors: Andrew J. Kielbania, Jr., Chalfont, PA (US); Klein A. Rodrigues, Signal Mountain, TN (US); Susanne Goodson, Warrington, PA (US); Christopher G. Gore, Cartersville, GA (US)

(73) Assignee: National Starch and Chemical Investment Holding Corporation, New Castle, DE (US)

( * ) Notice: Subject to any disclaimer, the term of this patent is extended or adjusted under 35 U.S.C. 154(b) by 0 days.

(21) Appl. No.: 09/456,358

(22) Filed: Dec. 8, 1999

(51) Int. Cl.[7] ..... D06M 13/322; D06M 15/564

(52) U.S. Cl. ..... 252/8.61; 8/115.51; 252/8.91; 442/107

(58) Field of Search ..... 252/8.61, 8.91; 442/107; 564/32, 44, 48, 55, 58; 525/374; 8/115.51

(56) References Cited

U.S. PATENT DOCUMENTS

| | | | | |
|---|---|---|---|---|
| 3,260,565 | * | 7/1966 | Beachem | 8/116.1 |
| 4,295,846 | * | 10/1981 | Petersen et al. | 8/186 |
| 4,300,898 | * | 11/1981 | North | 8/185 |
| 4,332,586 | * | 6/1982 | North | 8/186 |
| 5,879,749 | * | 3/1999 | Rodrigues et al. | 427/393.2 |
| 5,965,466 | * | 10/1999 | Rodrigues et al. | 442/107 |

* cited by examiner

*Primary Examiner*—Anthony Green
(74) *Attorney, Agent, or Firm*—Thomas F. Roland

(57) ABSTRACT

A textile treatment composition which imparts anti-wrinkling properties to textiles treated therewith, said textile treatment composition comprising a polyhydroxyalkylurea crosslinking agent having at least two urea moieties. Textiles treated with the compositions of the invention display a significant reduction in wrinkles compared with nontreated textiles. Moreover, the treated textiles have a tactile sensation of feeling soft and retain their smoothness after laundering.

29 Claims, No Drawings

TREATMENT COMPOSITION WHICH PROVIDES ANTI-WRINKLING PROPERTIES TO TEXTILES

FIELD OF THE INVENTION

This invention relates to a textile treatment composition comprising a olyhydroxyalkylurea crosslinking agent having at least two urea moieties.

BACKGROUND OF THE INVENTION

The use of thermosetting resins or reactants to impart crease resistance and dimensional stability to textile materials is known in the art. These materials, known as "aminoplast resins", include the products of the reaction of formaldehyde with such compounds as urea, thiourea, ethylene urea, dihydroxyethylene urea, melamines or the like. A serious drawback to the use of such materials is that they contain free formaldehyde. This is present during the preparation and storage of the finishing agent and its use in treating textiles, on the treated fabric, and on the finished garments. Also, when the fabrics or garments made therefrom are stored under humid conditions, additional free formaldehyde is produced.

Treating textiles with resin compositions that do not contain or evolve formaldehyde is also known, as in U.S. Pat. No. 3,260,565 which describes finishing agents formed by the reaction of alkyl or aryl ureas or thioureas with glyoxal. U.S. Pat. Nos. 4,332,586 and 4,300,898 describe alkylated glyoxal/cyclic urea condensates as crosslinking agents for textiles. U.S. Pat. No. 4,295,846 describes a finishing agent for textiles which is prepared by reacting urea or symmetrically disubstituted ureas in an aqueous solution with glyoxal. Japanese publication No. 5 3044–567 describes finishing agents formed by the reaction of ethylene urea with glyoxal. These agents, however, have the disadvantage of having marginal anti-wrinkling properties.

U.S. Pat. No. 5,879,749 describes fabric treating compositions that contain a polymer having at least two carboxyl groups and a poly(hydroxy) crosslinking agent. U.S. Pat. No. 5,965,466 describes a method for imparting permanent press properties to a textile comprising applying a (hydroxyalkyl)urea or β-hydroxyalkylamide crosslinking agent to the textile.

The present invention provides a textile treatment composition which imparts anti-wrinkling properties to textiles treated therewith, said textile treatment composition comprising a polyhydroxyalkylurea crosslinking agent having at least two urea moieties which is selected from the group consisting of Structures I–III, respectively, as follows:

(I)

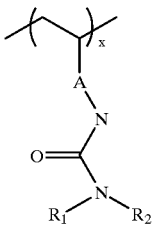

-continued (II)

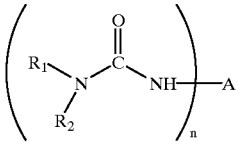

(III)

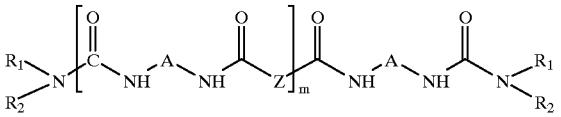

wherein A is independently selected from the group consisting of a $C_2$ to $C_{36}$ aliphatic group, a $C_6$ to $C_{40}$ alkaryl group; m is from 1 to 100; n is from 2 to 10; x is from 2 to 100; Z is selected from the group consisting of a diamine, triamine, diol and triol;

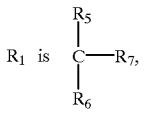

$R_2$ is independently selected from hydrogen or $R_5$; $R_5$ is independently selected from the group consisting of hydrogen,

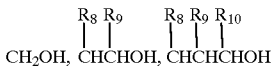

and $C_1$–$C_4$ alkyl; $R_6$ is selected from the group consisting of

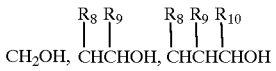

and $C_1$–$C_4$ alkyl; $R_7$ is selected from the group consisting of

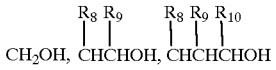

and $C_1$–$C_4$ alkyl; $R_8$, $R_9$ and $R_{10}$ are independently selected from the group consisting of hydrogen, methyl and ethyl.

According to another aspect the invention provides a textile treatment composition which imparts anti-wrinkling properties to textiles treated therewith, said textile treatment composition comprising the polyhydroxyalkylurea crosslinking agent and a polymer having at least two functional groups selected from the group consisting of carboxyl, anhydride, amine and combinations thereof.

Textiles treated with the compositions of the present invention display a significant reduction in wrinkles compared with nontreated textiles. Moreover, the treated textiles have a tactile sensation of feeling soft and retain their smoothness after laundering.

DESCRIPTION OF THE INVENTION

This invention relates to a textile treatment composition which imparts anti-wrinkling properties to textiles treated therewith. As used herein, "anti-wrinkling" is synonymous with wrinkle resistance, durable press, permanent press, dimensional stability, shrinkage resistance, and wrinkle recovery. The polyhydroxyalkylurea crosslinking agent is essentially free of formaldehyde and may be applied in the form of an aqueous solution or neat.

The textile may be woven or non-woven fabrics and includes, for example, polyester, cotton, rayon, and linen, as well as blends, for example, polyester/cotton or polyester/rayon. Both white and colored (printed, dyed, yarn-dyed, cross-dyed, etc.) fabrics can be effectively treated with the crosslinking agents of the invention. The textiles may comprise new or used clothing including previously worn clothing and/or laundered clothing.

The polyhydroxyalkylurea crosslinking agent has at least two urea moieties. The polyhydroxyalkylurea crosslinking agent is represented by Structures I–III as follows:

Structure I

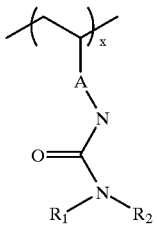

Structure II

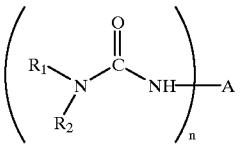

Structure III

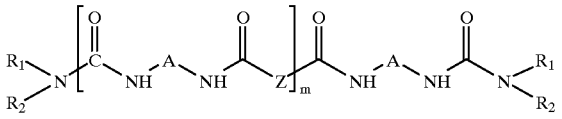

In Structures I–III, A is selected from the group consisting of a $C_2$ to $C_{36}$, preferably a $C_2$ to $C_{13}$ aliphatic group, a $C_6$ to $C_{20}$, preferably a $C_6$ to $C_{15}$ aromatic group, and a $C_6$ to $C_{40}$, preferably a $C_6$ to $C_{20}$ alkaryl group; Z is selected from the group consisting of a diamine, triamine, diol, and triol, preferably Z is a diol; m is from 1 to 100, preferably from 1 to 10; n is from 2 to 10, preferably from 2 to 4; x is from 2 to 100, preferably from 2–10;

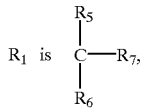

$R_2$ is independently selected from hydrogen or $R_5$; $R_5$ is independently selected from the group consisting of hydrogen,

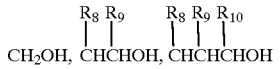

and $C_1$–$C_4$ alkyl; $R_6$ is selected from the group consisting of

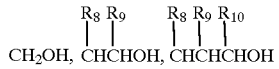

and $C_1$–$C_4$ alkyl; $R_7$ is selected from the group consisting of

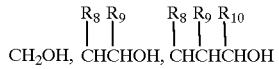

and $C_1$–$C_4$ alkyl; and $R_8$, $R_9$, and $R_{10}$ are independently selected from the group consisting of hydrogen, methyl and ethyl. A combination of polyhydroxyalkylurea crosslinking agents may be used in the textile treatment composition.

In one embodiment, the polyhydroxyalkylurea represented by Structure I is prepared by polymerizing ethylenically unsaturated monomers having at least one isocyanate moiety to form a polymer which is reacted with an alkanolamine.

In another embodiment, the polyhydroxyalkylurea represented by Structure I is prepared by reacting ethylenically unsaturated monomers containing at least one isocyanate moiety with an alkanolamine followed by polymerization of the monomers.

In one embodiment, the polyhydroxyalkylurea represented by Structure II is prepared by reacting an isocyanate monomer having at least two isocyanate moieties with an alkanolamine.

In one embodiment, the polyhydroxyalkylurea represented by Structure III is prepared by reacting a compound having at least two hydroxy or amine groups with an excess of a isocyanate monomer having at least two isocyanate moieties, to form a polyurethane prepolymer having terminal isocyanate moieties. The polyurethane prepolymer is reacted with an alkanolamine.

Examples of alkanolamines include 2-aminoethanol, 2,2'-iminobisethanol, 2,2',2"-nitrilotrisethanol, 1-amino-2-propanol, 1,1'-iminodi-2-propanol, 1,1',1"- nitrilotris-2-propanol, 1-amino-2-butanol, 1,1'-iminodi-2-butanol, 1,1',1"-nitrilotris-2-butanol, 2-dimethylaminoethanol, 2-diethylaminoethanol, 2-(2-aminoethylamino)ethanol, 2-methylaminoethanol, 2-butylaminoethanol, N-2-hydroxyethylacetamide, 2-anilinoethanol, 2-dibutylaminoethanol, 2-diisopropylaminoethanol, 2-N-ethylanilinoethanol, 2,2'-(methylimino)diethanol, 2,2'-(ethylimino)diethanol, 2,2'-(phenylimino)diethanol, 1-dimethylamino-2-propanol, and 1-(2-aminoethylamino)-2-propanol. Preferably the alkanolamnine is diethanolamine. A combination of alkanolamines can also be used.

The isocyanate monomer having at least two isocyanate moieties may be aromatic or aliphatic. Examples of polyisocyanates include methylene-diphenyl diisocyanate, methylene-bis(4-cyclohexyl-isocyanate), isophorone diisocyanate, toluene diisocyanate, 1,5-naphthalene diisocyanate, 4,4'diphenyl-methane diisocyanate, 2,2'-dimethyl-4,4'-diphenyl-methane diisocyanate, 4,4'-dibenzyl-diisocyanate, 1,3-phenylene diisocyanate, 1,4-phenylene diisocyanate, 2,6- and 2,4-tolylene diisocyanate, xylene diisocyanate, 2,2'-dichloro-4,4'-diisocyanatodiphenylmethane, 2,4-dibromo-1,5-diisocyanatonaphthalene, butane-1,4-diisocyanate, hexane-1,6 -diisocyanate, dimer acid diisocyanate (DDI), and cyclohexane-1,4-diisocyanate. A preferred polyisocyanate is hexamethylene diisocyanate. A combination of polyisocyanates may also be used.

The compound having at least two hydroxy or amine groups includes, for example, polyether diols, polyether/polyester diols, polyester diols, polyacetal diols, polyamide diols, polyester/polyamide diols, poly(alkylene ether)diols, polythioether diols, and polycarbonate diols. Polyethylene glycols containing hydrocarbon radicals can be used such as bisphenol-A ethoxylates. Examples of such bisphenol-A ethoxylates include SYNFAC which is available from the Milliken Chemical Co. and MACOL which is available from BASF Corporation. Additionally, ethylene/oxide/butyleneoxide or ethyleneoxide/butyleneoxide/propyleneoxide copolymers can also be used, for example, the commercially available PLURONICS from BASF Corporation. In addition, a hydroxy terminated polyurethane polyol based upon polyethylene glycol or an alkoxy based amine such as JEFFAMINE diamine or triamine, which have terminal amine groups, available from Hunstman, may also be used. JEFFAMINE is a trade name of Huntsman Corporation.

Examples of polyether diols include the condensation products of ethylene oxide, propylene oxide, butylene oxide, or tetrahydrofuran, and their copolymerization, graft or block polymerization products, such as mixed ethylene oxide, propylene oxide, condensates, and the graft polymerization products of the reaction of olefins under high pressure with alkylene oxide condensates.

Suitable polyester diols, polyester amide diols, and polyamide diols are preferably saturated, and are obtained, for example, from the reaction of saturated or unsaturated polycarboxylic acids with saturated or unsaturated polyhydric alcohols. Examples of carboxylic acids include adipic acid, succinic acid, phthalic acid, terephthalic acid, and maleic acid. Examples of compounds having at least two hydroxy or amine groups are ethylene glycol, 1,2-propylene glycol, 1,4-butanediol, neopentyl glycol, hexanediol, trimethylolpropane, ethanolamine, ethylene diamine, and hexamethylene diamine.

Suitable polyacetals can be prepared, for example, from 1,4-butanediol or hexanediol and formaldehyde. Suitable polythioether diols can be prepared, for example, by the condensation of thiodiglycol with ethylene oxide, propylene oxide, butylene oxide or tetrahydrofuran. The preferred polyols are trimethylol propane, 2-ethyl-2-(hydroxymethyl)-1,3-propanediol, pentaerythritol, glycerol and sorbitol.

An aqueous solution containing the crosslinking agent preferably has a pH of from about 1 to about 10, more preferably from about 2 to about 7. Most preferably, the aqueous solution containing the crosslinking agent has a pH of from about 3 to about 5. It is understood that any means of adjusting the pH of the aqueous solution may be employed in the method of the invention to achieve a desired pH.

In one embodiment of the invention, the textile treatment composition contains the polyhydroxyalkylurea crosslinking agent and a polymer having at least two functional groups selected from carboxyl, anhydride, amine and combinations thereof, wherein the polymer is not a polyhydroxyalkylurea crosslinking agent. Preferably, the polymer has at least two carboxyl groups. The polymer is prepared from monomers such as ethylene, vinyl acetate, methacrylic acid, acrylic acid, $C_1$ to $C_8$ alkyl esters of methacrylic or acrylic acid, maleic anhydride, maleic acid, itaconic acid, crotonic acid, carboxy ethyl acrylate, butadiene, styrene, and combinations thereof. A preferred polymer is polyacrylic acid.

Optionally, the method of the invention includes a catalyst to speed up the reaction between the crosslinking agents and/or the textile. However, the reaction between the crosslinking agents and/or textile does not require a catalyst. While not wishing to be bound by any particular theory, the inventors believe that a catalyst decreases the zeta potential or the amount of negative charge on the textile surface and thus increases the amount of crosslinking agent which is deposited on the textile or fabric. Any substance that can accept an electron pair from a base can be used as a catalyst.

Preferably, the catalyst is a Lewis acid catalyst selected from dibutyltindilaurate, iron(III)chloride, scandium(III) trifluoromethanesulfonic acid, boron trifluoride, tin(IV) chloride, $Al_2(SO_4)_3xH_2O$, $MgCl_2.6H_2O$, $AlK(SO_4)_2.10H_2O$, and Lewis acids having the formula $MX_n$ wherein M is a metal, X is a halogen atom or an inorganic radical, and n is an integer of from 1 to 4, such as $BX_3$, $AlX_3$, $FeX_3$, $GaX_3$, $SbX_3$, $SnX_4$, $AsX_5$, $ZnX_2$, and $HgX_2$. More preferably, the Lewis acid catalyst is selected from $Al_2(SO_4)_3xH_2O$, $MgCl_2.6H_2O$, $AlK(SO_4)_2.10H_2O$. A combination of catalysts can also be used in the method of the invention.

Any method of applying the crosslinking agent to the textile is acceptable. Preferably, the textile is impregnated with an aqueous solution of the crosslinking agent. As used herein, "impregnate" refers to the penetration of the solution into the fiber matrix of the textile, and to the distribution of the solution in a preferably substantially uniform manner into and through the interstices in the textile. The solution therefore preferably envelopes, surrounds, and/or impregnates individual fibers substantially through the thickness of the textile as opposed to only forming a surface coating on the textile.

In one embodiment of the invention, the aqueous solution of the crosslinking agent is applied to the textile in a textile manufacturing process as part of the durable press finishing operation.

In one embodiment of the invention, where the textile is not treated in a textile manufacturing process, the crosslinking agent is applied in a laundering process, most preferably to rinse water in the rinse cycle of the laundering process at home or at a laundrymat.

In one embodiment of the invention, the crosslinking agent is added to a laundering process during the wash cycle.

In one embodiment of the invention, the crosslinking agent is applied by soaking the textile in an aqueous solution containing the crosslinking agent.

In one embodiment of the invention, the crosslinking agent is applied by spraying an aqueous solution containing the crosslinking agent on a textile.

In one embodiment of the invention, the crosslinking agent is applied by spraying an aqueous solution containing the crosslinking agent on a textile and then ironing the textile.

The treated textile is cured at room temperature or at the normal temperatures provided by either a drying unit used in a textile manufacturing process such as a steam heated drying cylinder, an oven, or an iron. Drying temperatures generally range from about 20° C. to about 300° C. Such temperatures permit water to be removed, thereby inducing crosslinking, for example, by means of ether linkages, of the polyhydroxyalkylurea crosslinking agent with the textile. One of the advantages of the crosslinkers of the present invention is that they are stable at elevated temperatures and therefore work particularly well in systems which must be cured at temperatures greater than about 90° C.

In the case where a treated textile is dried by means of a dryer unit, oven, or iron, the residence time ranges from about 1 second to about 200 seconds, depending on the temperature. The actual residence time for a particular textile sample depends on the temperature, pressure, type of fabric, and the type and amount of catalyst. Preferably, the time and temperature required to cure the polyhydroxyalkylurea crosslinking agent with the textile ranges from about 2 to about 60 seconds at a textile temperature ranging from about 20° C. to about 250° C. After the textile with the solution of the crosslinking agent applied thereto is dried/cured, subsequent coatings or additives such as starch may be applied.

In a preferred embodiment, a textile treated with the polyhydroxyalkylurea crosslinking agent is ironed both on the inside and outside surfaces to maximize the amount of crosslinking and thus anti-wrinkling properties of the textile.

Preferred means of applying the aqueous solution of the crosslinking agent on a textile manufacturing machine are by puddle press, size press, blade coater, speedsizer, spray applicator, curtain coater and water box. Preferred size press configurations include a flooded nip size press and a metering blade size press.

Preferred means of applying the aqueous solution of the crosslinking agent on off-machine coating equipment in a textile manufacturing process are by rod, gravure roll and air knife. The solution may also be sprayed directly onto the textile or onto rollers which transfer the solution to the textile. In an especially preferred embodiment of the invention, impregnation of the textile with the aqueous solution of the crosslinking agent occurs by means of a puddle size press.

Preferred means of applying the aqueous solution of the crosslinking agent in a laundering process are by adding the solution to the rinse water during the rinse cycle in the laundering process. In an especially preferred embodiment of the invention, impregnation of the textile with the aqueous solution of the crosslinking agent occurs during the final rinse cycle in a laundering process. In an additional especially preferred embodiment of the invention, impregnation of the textile with the aqueous solution of the crosslinking agent occurs in a washing machine which contains at least one textile, the crosslinker and optionally a catalyst, wherein the washing machine is not operating so that the textile remains in contact with the treatment solution for a period of time to facilitate the impregnation of the treatment solution into the textiles. The washing machine is turned on to the spin cycle, the textiles are removed, and dried.

Another preferred means of applying the aqueous solution of the crosslinking agent to a textile such as clothing is spraying by means of a pump or aerosol a solution of the crosslinking agent onto the textile.

The concentration of the polyhydroxyalkylurea crosslinking agent in an aqueous solution is from about 0.001 to about 50 weight percent, preferably 0.01 to 10 weight percent, based on the total weight of the aqueous solution. More preferably, the concentration of the crosslinking agent in an aqueous solution is from 0.1 to 2 weight percent.

The following nonlimiting examples illustrate further aspects of the invention.

EXAMPLE 1

Preparation of Polyhydroxyalkylurea Crosslinking Agent Having Structure I

Polymethylene polyphenylisocyanate, commercially available as PAPI 135, equivalent molecular weight of 133.5 and an average isocyanate functionality of 2.7, was reacted with diethanolamine in a molar ratio of NCO/NH of 1:1.

EXAMPLE 2

Preparation of Polyhydroxyalkylurea Crosslinking Agent Having Structure II

At 23° C., 105 g of diethanolamine was added over 2 hours to a solution of 84 g of hexamethylene diisocyanate in 200 g of acetone. ($R_1$ and $R_2$ are ethanol) The temperature increased to approximately 30° C. and the solution became thick and hazy. The reaction was followed by monitoring the disappearance of the isocyanate peak by IR spectroscopy. After 5 hours, the acetone was distilled off to yield a viscous clear liquid.

EXAMPLE 3

Preparation of Polyhydroxyalkylurea Crosslinking Agent Having Structure II

At 23° C., 51.1 g of dimethylaminopropylamine was added over 2 hours to a solution of 84.1 g of hexamethylene diisocyanate in 200 g of acetone. The reaction was stirred for 2 hours and then 52.6 g of diethanolamine was added over 2 hours at room temperature. After 5 hours, the acetone was distilled off to yield a viscous clear liquid.

EXAMPLE 4

Preparation of Polyhydroxyalkylurea Crosslinking Agent Having Structure III

A solution of 150 g of ethyl acetate and 140 g of PEG 8000 (polyethylene glycol having a molecular weight of 8000) was heated to reflux with a nitrogen purge for 30 minutes to remove about 10 mL of ethyl acetate and any residual water. The solution was cooled to 65° C. and 7.7 g of hexamethylene diisocyanate and 0.2 g of dibutyltinlaurate were added. The reaction solution was held at 65° C. for 24 hours while stirring. The temperature was raised to reflux and 5.93 g of diethanolamine (0.0564 moles) was added. After 5 hours, 160 g of water was added and the ethyl acetate was distilled off in about 2 hours.

EXAMPLE 5

Preparation of Polyhydroxyalkylurea Crosslinking Agent Having Structure III

A polyhydroxyalkyl urea was prepared according to the procedure set forth in Example 4, except that the PEG 8000 was replaced with PPG 400 (polypropylene glycol having a molecular weight of 400).

EXAMPLE 6

Preparation of Polyhydroxyalkylurea Crosslinking Agent Having Structure III

A polyhydroxyalkyl urea was prepared according to the procedure set forth in Example 4, except that the PEG 8000 was replaced with RUCOFLEX S107–110 (neopentyladipate polyol from Ruco Polymer Corporation).

EXAMPLE 7

Preparation of Polyhydroxyalkylurea Crosslinking Agent Having Structure III

A polyhydroxyalkyl urea was prepared according to the procedure set forth in Example 4, except that diethanolamine was replaced with ethanolamine.

EXAMPLE 8

Preparation of Polyhydroxyalkylurea Crosslinking Agent Having Structure III

A polyhydroxyalkyl urea was prepared according to the procedure set forth in Example 4, except that diethanolamine was replaced with propanolamine.

EXAMPLE 9

Preparation of Polyhydroxyalkylurea Crosslinking Agent Having Structure III

A polyhydroxyalkyl urea was prepared according to the procedure set forth in Example 4, except that diethanolamine was replaced with 1,1-dimethylolpropylamine.

EXAMPLE 10

Preparation of Polyhydroxyalkylurea Crosslinking Agent Having Structure III

A polyhydroxyalkyl urea was prepared according to the procedure set forth in Example 4, except that hexamethylene diisocyanate was replaced with isophorone diisocyanate.

EXAMPLE 11

Preparation of Polyhydroxyalkylurea Crosslinking Agent Having Structure III

A polyhydroxyalkyl urea was prepared according to the procedure set forth in Example 4, except that hexamethylene diisocyanate was replaced with methylene-bis(4-cyclohexylisocyanate).

EXAMPLE 12

Preparation of Polyhydroxyalkylurea Crosslinking Agent Having Structure III

A polyhydroxyalkyl urea was prepared according to the procedure set forth in Example 4, except that hexamethylene diisocyanate was replaced with toluene diisocyanate.

EXAMPLE 13

Cotton swatches, 4"×6.5" were soaked for 10 minutes in varying concentrations as set forth in Table I of a polyhydroxyalkylurea crosslinking agent prepared in Examples 2 or 3, and $MgCl_2.6H_2O$ catalyst in aqueous solution. A control swatch was presoaked with water without the polyhydroxyalkylurea crosslinking agent or catalyst. The swatches were ironed at high heat until dry. The swatches were washed separately in a TERG-O-TOMETER under the following wash conditions: 1L 110 ppm hardness water (2:1 $CaCl_2$ to $MgCl_2$), 94° C., 0.9 g/l AATCC standard detergent, 10 minute wash, 3 minute rinse. The swatches were squeezed tightly and dried in a commercial clothes dryer using the "normal" setting for 20 minutes. The swatches were laid on a flat surface and the major folds were removed, but no attempt was made to stretch the fabric. The swatches were evaluated for wrinkles on a subjective scale of 1 to 5 wherein 1 signified very few wrinkles and 5 signified a majority of wrinkles. The test results are summarized in Table I.

TABLE I

Permanent Press Finishing on Cotton Swatches.

| Swatch # | Polyhydroxyalkylurea | Polyhydroxyalkylurea wt. % | $MgCl_2$ $6H_2O$ wt. % | Visual Rating | Result |
|---|---|---|---|---|---|
| Control | None | 0 | 0 | 5 | very wrinkled |
| 1 | Ex. 2 | 4 | 2.5 | 4 | less wrinkled than control |

TABLE I-continued

Permanent Press Finishing on Cotton Swatches.

| Swatch # | Polyhydroxyalkylurea | Polyhydroxyalkylurea wt. % | $MgCl_2$ $6H_2O$ wt. % | Visual Rating | Result |
|---|---|---|---|---|---|
| 2 | Ex. 3 | 4 | 2.5 | 4 | less wrinkled than control |
| 3 | Ex. 2 | 8 | 5 | 2 | very few wrinkles |
| 4 | Ex. 3 | 8 | 5 | 2 | very few wrinkles |

The test results in Table I show that the cotton swatches pretreated with the polyhydroxyalkylurea crosslinking agents of the invention and catalyst were significantly less wrinkled after washing than the control swatch which was not pretreated with the polyhydroxyalkylurea crosslinking agents.

While the invention has been described with particular reference to certain embodiments thereof, it will be understood that changes and modifications may be made by those of ordinary skill in the art within the scope and spirit of the following claims.

What is claimed is:

1. A textile treatment composition which imparts anti-wrinkling properties to textiles treated therewith, said textile treatment composition comprising a polyhydroxyalkylurea crosslinking agent having at least two urea moieties which is selected from the group consisting of Structures I–III, respectively, as follows:

(I)

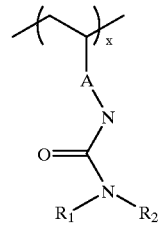

(II)

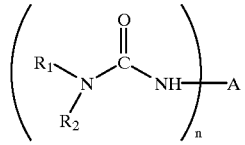

(III)

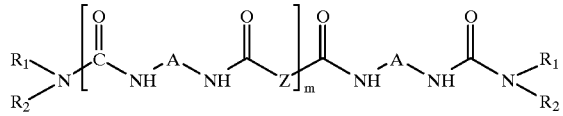

wherein A is independently selected from the group consisting of a $C_2$ to $C_{36}$ aliphatic group, a $C_6$ to $C_{20}$ aromatic group, and a $C_6$ to $C_{40}$ alkaryl group; m is from 1 to 100; n is from 2 to 10; x is from 2 to 100; Z is selected from the group consisting of a diamine, triamine, diol and triol;

$R_2$ is independently selected from hydrogen or $R_5$; $R_5$ is independently selected from the group consisting of hydrogen,

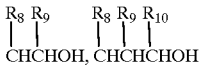

and $C_1$–$C_4$ alkyl; $R_7$ is selected from the group consisting of

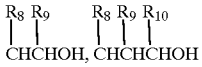

and $C_1$–$C_4$ alkyl; $R_7$ is selected from the group consisting of

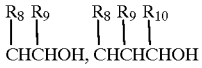

and $C_1$–$C_4$ alkyl; and $R_8$, $R_9$, and $R_{10}$ are independently selected from the group consisting of hydrogen, methyl and ethyl.

2. A textile treatment composition which imparts anti-wrinkling properties to textiles treated therewith, said textile treatment composition comprising a polyhydroxyalkylurea crosslinking agent having at least two urea moieties which is selected from the group consisting of Structures I–III, respectively, as follows:

(I)

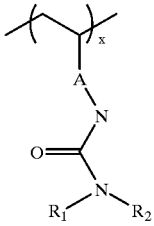

(II)

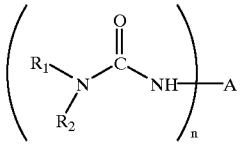

(III)

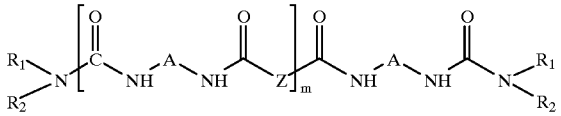

wherein A is independently selected from the group consisting of a $C_2$ to $C_{36}$ aliphatic group, a $C_6$ to $C_{20}$ aromatic group, and a $C_6$ to $C_{40}$ alkaryl group; m is from 1 to 10; n is from 2 to 4; x is from 2–10; Z is selected from the group consisting of a diamine, triamine, diol and triol;

$R_1$ is 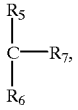

$R_2$ is independently selected from hydrogen or $R_5$; $R_5$ is independently selected from the group consisting of hydrogen,

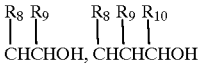

and $C_1$–$C_4$ alkyl; $R_7$ is selected from the group consisting of

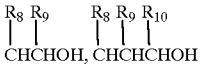

and $C_1$–$C_4$ alkyl; $R_7$ is selected from the group consisting of

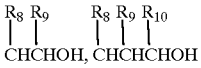

and $C_1$–$C_4$ alkyl; and R8, $R_9$ and $R_{10}$ are independently selected from the group consisting of hydrogen, methyl and ethyl.

3. The textile treatment composition according to claim 1 wherein the textile is selected from the group consisting of cotton, polyester, rayon, linen, polycotton, polyrayon, and combinations thereof.

4. The textile treatment composition according to claim 3 wherein the textile is cotton.

5. The textile treatment composition according to claim 1 wherein said polyhydroxyalkylurea crosslinking agent represented by Structure I is prepared by a method comprising polymerizing ethylenically unsaturated monomers having at least one isocyanate moiety to form a polymer, and reacting the polymer with an alkanolamine.

6. The textile treatment composition according to claim 1 wherein said polyhydroxyalkylurea crosslinking agent represented by Structure I is prepared by a method comprising reacting ethylenically unsaturated monomers containing at least one isocyanate moiety with an alkanolamine, and polymerizing the monomers.

7. The textile treatment composition according to claim 1 wherein said polyhydroxyalkylurea crosslinking agent represented by Structure II is prepared by a method comprising reacting an isocyanate monomer having at least two isocyanate moieties with an alkanolamine.

8. The textile treatment composition according to claim 1 wherein said polyhydroxyalkylurea crosslinking agent represented by Structure III is prepared by a method comprising reacting a compound having at least two hydroxy or amine groups with an excess of a isocyanate monomer having at least two isocyanate moieties, to form a polyurethane prepolymer having terminal isocyanate moieties, and reacting the polyurethane prepolymer with an alkanolamine.

9. The textile treatment composition according to claim 5 wherein said alkanolamine is selected from the group consisting of 2-aminoethanol, 2,2'-iminobisethanol, 2,2',2"-nitrilotrisethanol, 1-amino-2-propanol, 1,1'-iminodi-2-propanol, 1,1',1"-nitrilotris-2-propanol, 1-amino-2-butanol, 1,1'-iminodi-2-butanol, 1,1',1"-nitrilotris-2-butanol, 2-dimethylaminoethanol, 2-diethylaminoethanol, 2-(2-aminoethylamino)ethanol, 2-methylaminoethanol, 2-butylaminoethanol, N-2-hydroxyethylacetamide, 2-anilinoethanol, 2-dibutylaminoethanol, 2-diisopropylaminoethanol, 2-N-ethylanilinoethanol, 2,2'-(methylimino)diethanol, 2,2'-(ethylimino)diethanol, 2,2'-(phenylimino)diethanol, 1-dimethylamino-2-propanol, 1-(2-aminoethylamino)- 2-propanol, and combinations thereof.

10. The textile treatment composition according to claim 5 wherein said alkanolamine is diethanolamine.

11. The textile treatment composition according to claim 7 wherein said isocyanate monomer having at least two isocyanate moieties is selected from the group consisting of methylene-diphenyl diisocyanate, methylene-bis(4-cyclohexyl-isocyanate), isophorone diisocyanate, toluene diisocyanate, 1,5-naphthalene diisocyanate, 4,4'diphenyl-methane diisocyanate, 2,2'-dimethyl-4,4'-diphenyl-methane diisocyanate, 4,4'-dibenzyl-diisocyanate, 1,3-phenylene diisocyanate, 1,4-phenylene diisocyanate, 2,6- and 2,4-tolylene diisocyanate, xylene diisocyanate, 2,2'-dichloro-4,4'-diisocyanatodiphenylmethane, 2,4-dibromo-1,5-diisocyanatonaphthalene, butane-1,4-diisocyanate, hexane-1,6-diisocyanate, cyclohexane-1,4-diisocyanate, dimer acid diisocyanate (DDI), and combinations thereof.

12. The textile treatment composition according to claim 7 wherein said isocyanate monomer having at least two isocyanate moieties is hexamethylene diisocyanate.

13. The textile treatment composition according to claim 1 further comprising a Lewis acid catalyst.

14. The textile treatment composition according to claim 13 wherein the Lewis acid catalyst is selected from the group consisting of dibutyltindilaurate, iron(III)chloride, scandium (III)trifluoromethanesulfonic acid, boron trifluoride, tin(IV) chloride, $Al_2(SO_4)_3xH_2O$, $MgCl_2.6H_2O$, $AlK(SO_4)_2.10H_2O$, and $BX_3$, $AlX_3$, $FeX_3$, $GaX_3$, $SbX_3$, $SnX_4$, $AsX_5$, $ZnX_2$, $HgX_2$, wherein X is a halogen atom or an inorganic radical.

15. The textile treatment composition according to claim 14 wherein the Lewis acid catalyst is selected from the group consisting of $Al_2(SO_4)_3xH_2O$, $MgCl_2.6H_2O$, $AlK(SO_4)_2.10H_2O$.

16. The textile treatment composition according to claim 1 comprising 0.001 to 50 weight percent of said polyhydroxyalkylurea crosslinking agent, and further comprising water.

17. The textile treatment composition according to claim 16 comprising 0.01 to 10 weight percent of said polyhydroxyalkylurea crosslinking agent.

18. The textile treatment composition according to claim 1 comprising 0.1 to 2 weight percent of said polyhydroxyalkylurea crosslinking agent.

19. The textile treatment composition according to claim 1 wherein said textiles are treated during a rinse cycle of a laundering process.

20. The textile treatment composition according to claim 1 wherein said textiles are treated during a rinse wash cycle of a laundering process.

21. The textile treatment composition according to claim 16 further comprising a Lewis acid catalyst.

22. The textile treatment composition according to claim 21 wherein the Lewis acid catalyst is added to rinse water during the rinse cycle of the laundering process.

23. The textile treatment composition according to claim 1 wherein an aqueous solution containing the polyhydroxyalkylurea crosslinking agent has a pH of from about 1 to about 10.

24. The textile treatment composition according to claim 23 wherein the aqueous solution containing the polyhydroxyalkylurea crosslinking agent has a pH of from about 2 to about 7.

25. A textile treated with the textile treatment composition according to claim 1.

26. A textile treatment composition which imparts anti-wrinkling properties to textiles treated therewith, said textile treatment composition comprising (a) 0.1 to 10 weight percent, based on the total weight of the textile treatment composition, of a polymer having at least two functional groups selected from the group consisting of carboxyl, anhydride, amine and combinations thereof;

(b) a polyhydroxyalkylurea crosslinking agent having at least two urea moieties wherein (a) and (b) are not the same, said polyhydroxyalkylurea crosslinking agent is selected from the group consisting of Structure I–III, respectively, as follows:

(I)

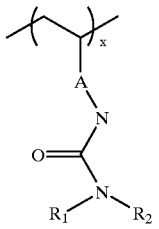

(II)

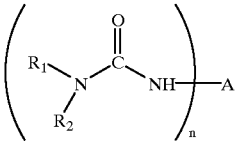

(III)

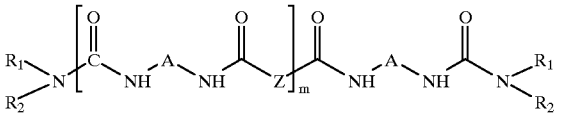

wherein A is independently selected from the group consisting of a $C_2$ to $C_{26}$ aliphate group, a $C_6$ to $C_{20}$ aromatic group, and a $C_6$ to $C_{40}$ alkaryl group; m is from 1 to 100; n is from 2 to 10; x is from 2 to 100; Z is selected from the group consisting of a diamine, triamine, diol and triol;

$R_1$ is 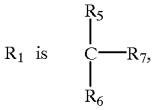 , $R_2$ is independently selected from hydrogen or $R_5$; $R_5$ is independently selected from the group consisting of hydrogen,

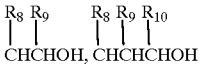

and $C_1$–$C_4$ alkyl; $R_6$ is selected from the group consisting of

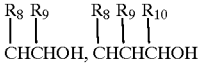

and $C_1$–$C_4$ alkyl; $R_7$ is selected from the group consisting of

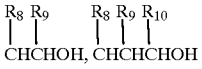

and $C_1$–$C_4$ alkyl; $R_8$, $R_9$ and $R_{10}$ are independently selected from the group consisting of hydrogen, methyl and ethyl.

27. The textile treatment composition according to claim 26 wherein the polymer, component (a), has at least two carboxyl groups.

28. The textile treatment composition according to claim 27 wherein the polymer is prepared from at least one monomer selected from the group consisting of ethylene, vinyl acetate, methacrylic acid, acrylic acid, $C_1$ to $C_8$ alkyl esters of methacrylic or acrylic acid, maleic anhydride, maleic acid, itaconic acid, crotonic acid, carboxy ethyl acrylate, butadiene, and styrene.

29. The textile treatment composition according to claim 27 wherein the polymer is polyacrylic acid.

* * * * *